US008393612B2

(12) United States Patent
Nunn

(10) Patent No.: US 8,393,612 B2
(45) Date of Patent: Mar. 12, 2013

(54) REMOVABLE CURRENCY STORAGE UNIT WITH CONTENT ACCESS MONITORING

(75) Inventor: Michael D. Nunn, West Chester, PA (US)

(73) Assignee: MEI, Inc., Malvern, PA (US)

( * ) Notice: Subject to any disclaimer, the term of this patent is extended or adjusted under 35 U.S.C. 154(b) by 0 days.

(21) Appl. No.: 13/061,049

(22) PCT Filed: Aug. 28, 2009

(86) PCT No.: PCT/US2009/055370

§ 371 (c)(1),
(2), (4) Date: May 20, 2011

(87) PCT Pub. No.: WO2010/025371

PCT Pub. Date: Mar. 4, 2010

(65) Prior Publication Data

US 2011/0154742 A1 Jun. 30, 2011

Related U.S. Application Data

(60) Provisional application No. 61/092,994, filed on Aug. 29, 2008.

(51) Int. Cl.
*B65H 1/00* (2006.01)

(52) U.S. Cl. ..... 271/145; 271/162

(58) Field of Classification Search ..... 271/145, 271/162; 221/197, 287

See application file for complete search history.

(56) References Cited

U.S. PATENT DOCUMENTS

| | | | |
|---|---|---|---|
| 4,106,667 | A | 8/1978 | Lynott |
| 2001/0054643 | A1 | 12/2001 | Siemens |
| 2004/0213620 | A1 | 10/2004 | Bergeron et al. |

FOREIGN PATENT DOCUMENTS

| | | | |
|---|---|---|---|
| EP | 0692599 | A1 | 1/1996 |
| EP | 1045349 | A1 | 10/2000 |
| EP | 1345187 | A2 | 9/2003 |
| GB | 2329994 | A | 4/1999 |
| WO | WO9953452 | A1 | 10/1999 |
| WO | WO2007016091 | A2 | 2/2007 |

OTHER PUBLICATIONS

PCT International Search Report, PCT/US2009/055370, Feb. 3, 2010.

*Primary Examiner* — David H Bollinger

(74) *Attorney, Agent, or Firm* — Mintz, Levin, Cohn, Ferris, Glovsky, and Popeo, P.C.

(57) ABSTRACT

A removable currency storage device is arranged to monitor and record access to the contents of the storage device.

20 Claims, 8 Drawing Sheets

REMOVABLE CURRENCY STORAGE UNIT WITH CONTENT ACCESS MONITORING

CROSS REFERENCE TO RELATED APPLICATIONS

This application is a national phase filing under 35 U.S.C. §371 of International application number PCT/US2009/055370, filed Aug. 28, 2009, which claims priority from provisional application No. 61/092,994 filed Aug. 29, 2008. The entire content of the prior applications are incorporated herein by reference in their entirety.

FIELD OF DISCLOSURE

The disclosure relates to a removable currency storage unit with content access monitoring.

BACKGROUND

There exist various devices for accepting, storing and dispensing valuable documents. For example, vending machines, gaming machines and automated tellers include various types of modules or devices for storing valuable documents (e.g., banknotes) or coins (e.g., tokens). Automated transaction machines (e.g., vending machines) typically have a main control unit for controlling the overall operation. The main control unit communicates with each of the peripheral modules to achieve desired operation and proper accounting of inserted currency. Currency is stored within a removable device such that the currency stored therein can be extracted at a remote location. In such scenarios, the removable storage device is arranged for selective engagement with a host apparatus (e.g., a vending machine) such that service personnel can remove the storage device and replace it with a similar empty one.

Vending machines (or other automated transaction machines) can be configured to include a unit (or component) in which currency is recycled such that inserted currency can be temporarily stored for later dispensing as change in a future transaction. With such recycling devices, it occasionally is necessary to service these devices. In some service calls, a jammed note or coin may need to be cleared from the device, or the device may not be working properly. To service a currency storage device, the internal region of the device may need to be accessed and, thus, the contents become exposed. Exposure of the contents of a currency storage device presents a low security scenario, such that the possibility of theft is greatly increased.

SUMMARY

The disclosure relates to a removable currency storage unit arranged to monitor and record access to the contents of the storage unit.

Various aspects of the invention are set forth in the claims.

For example, one aspect relates to a content access monitoring system for a removable currency storage module having a movable access cover for exposing the contents of the removable currency storage module. The content access monitoring system includes an access identification mechanism for establishing whether the access cover has been moved between a closed position and an open position. The access identification mechanism includes a movable member arranged to move between an initial state indicating a closed position of the access cover and a further state indicating movement of the access cover to an open position. The content access monitoring system further includes an actuation device for causing the movable member to be positioned in the initial state upon activation and a sensor arranged to send information relating to a state change of the moveable member based on activation of the actuation device.

In some implementations, the removable storage device is of a type configured to store currency temporarily for later dispensing as change in a future transaction. In other implementations the removable storage device stores currency for retrieval and transport for later processing at a location remote from the host machine.

The removable storage device is arranged for selective coupling with a host machine and houses currency inserted into the host machine. It is commonly known to provide a note storage device in the form of a removable cassette. Typical removable cassettes stack notes in a face to face condition. In other known devices, notes are stored within a removable storage device by winding notes about a circular drum. In other implementations, the removable storage device stores coins in a stacked (or face-to-face) condition (e.g., coin tubes). In other implementations, the currency storage device stores coins in other conditions (e.g., bulk bins).

In some implementations, the removable storage device is arranged for recording when the contents of the device have been accessed. The access identification mechanism is arranged to sense when the contents of the device have been accessed. In some configurations, the access identification mechanism is arranged to record an internal access in an un-powered or powerless condition. When power to the host machine (or that provided to the storage device) is removed, some known removable storage devices can become susceptible to internal access without knowledge by the host machine. Thus, in some implementations of the invention, a currency storage device is arranged with a access identification mechanism that provides the host machine (or device controller) with information about an access event when no power is present. Upon power up of the host machine (or insertion of the currency storage device into a processing machine), the currency storage device can provide the host machine (e.g. via device controller) with information that allows for the recording of any access to the storage device after the last known communication between the host and the currency storage device.

Various implementations provide one or more of the following advantages. For example, when a device storing currency (e.g., banknotes or coins) requires removal from a host machine, the event can be recorded so as to reduce the likelihood of fraudulent behavior (e.g., theft of stored banknotes). The removal (or access to the contents) of storage devices coupled to a host machine can be recorded even when the power to the device or host machine is removed.

The access identification mechanism can be used in various applications including, but not limited to, vending machines, ATMS, gaming machines, or any other host apparatus utilizing a removable storage unit housing currency.

Other features and advantages will be readily apparent from the detailed description, the accompanying drawings, and the claims.

DETAILED DESCRIPTION

For the purposes of this disclosure, "currency" includes, but is not limited to, valuable papers, banknotes, bills, coupons, checks, notes, coins, tokens, or any other items (genuine or non-genuine) of value used in exchange for goods or services.

As is known in the art, a vending machine often includes at least one removable currency storage device for storing inserted currency. The inserted currency is verified as authentic by a validation module in which acceptable currency is transported to one or more currency storage units. In some implementations, the currency storage unit is removable from the host machine (e.g., vending machine) and may be arranged to temporarily store inserted currency (i.e., to recycle currency) for use in a later transaction.

Figure 1:
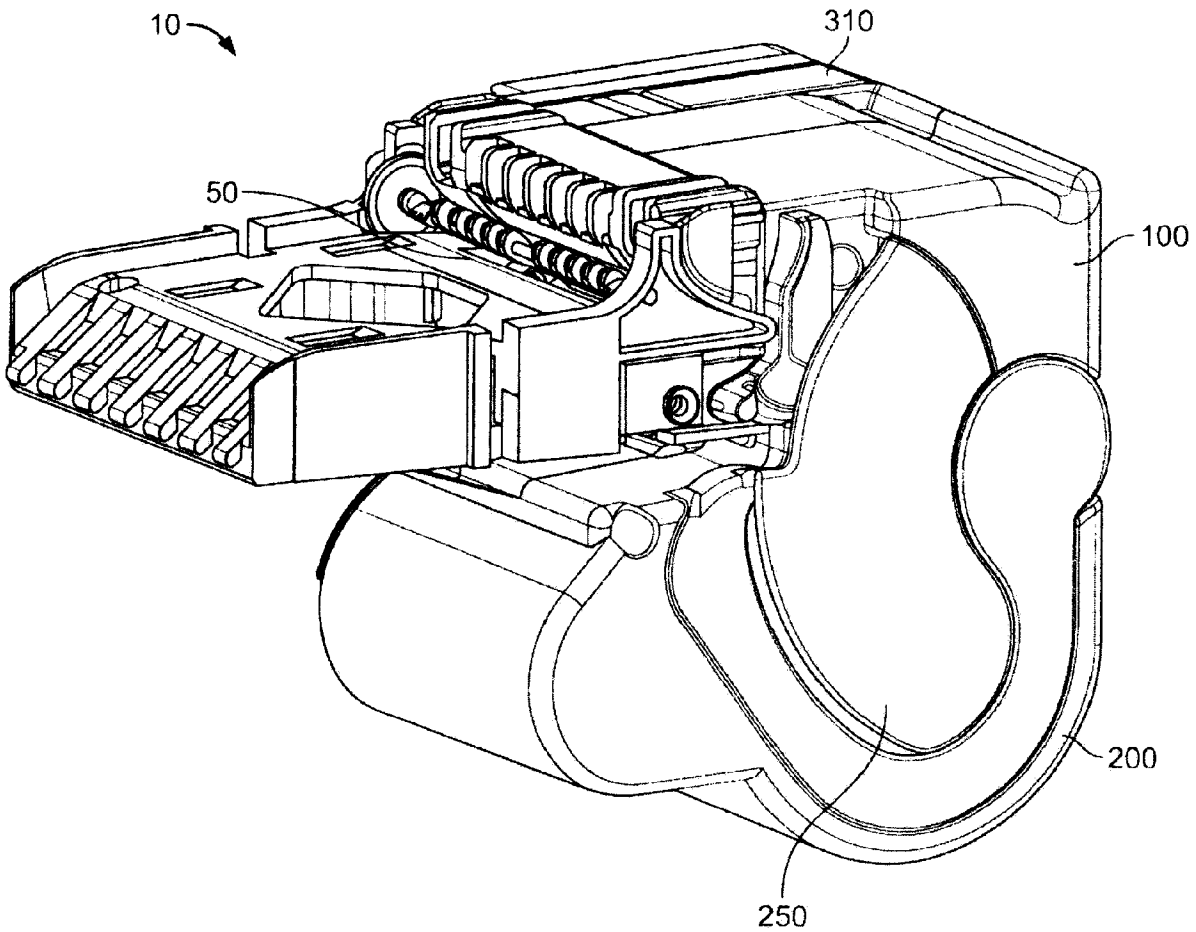
FIG. 1 illustrates a removable currency storage unit.
Figure 2:
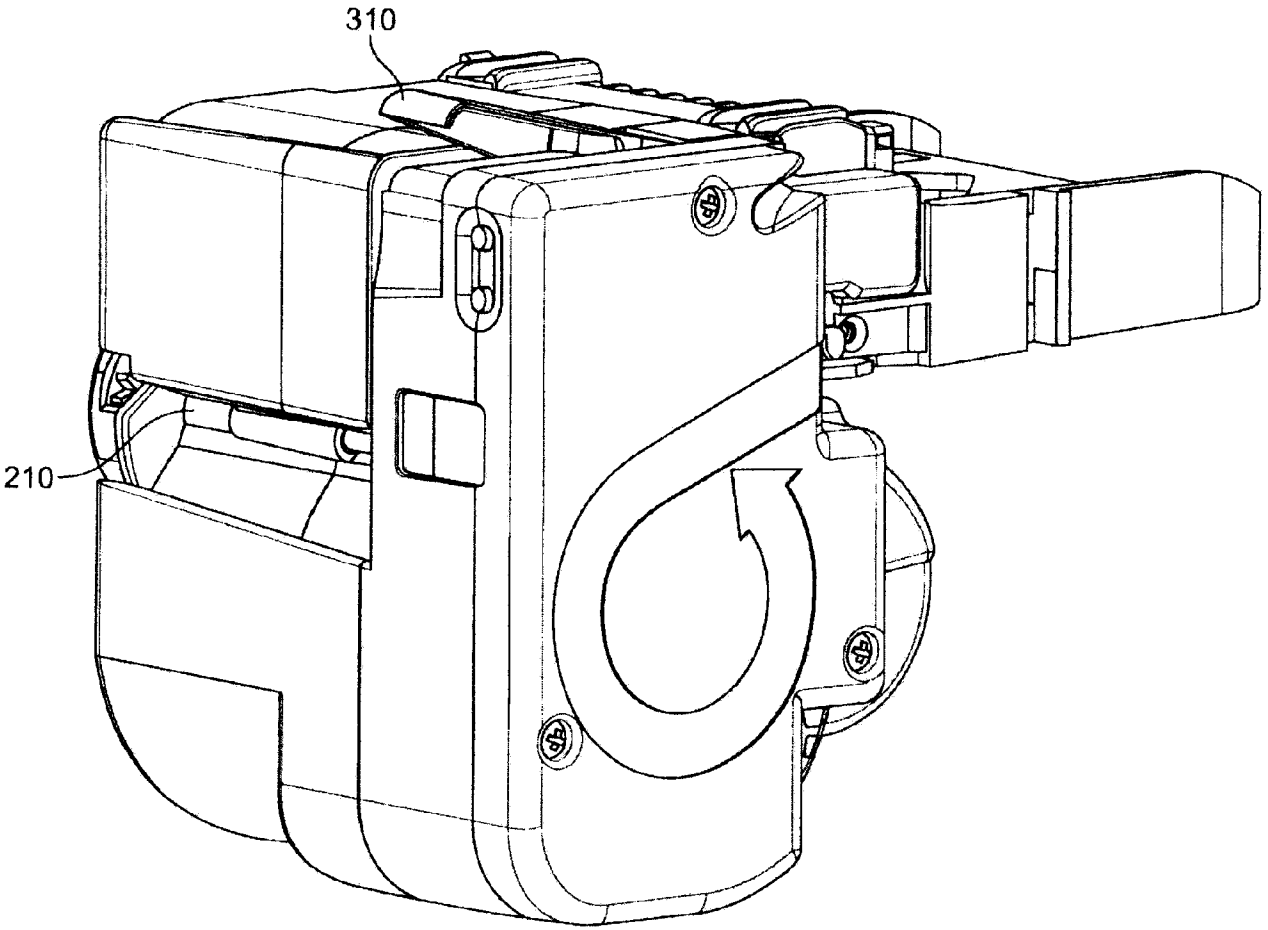
FIG. 2 illustrates a view of the removable currency storage unit with a movable cover latch.
Figure 3:
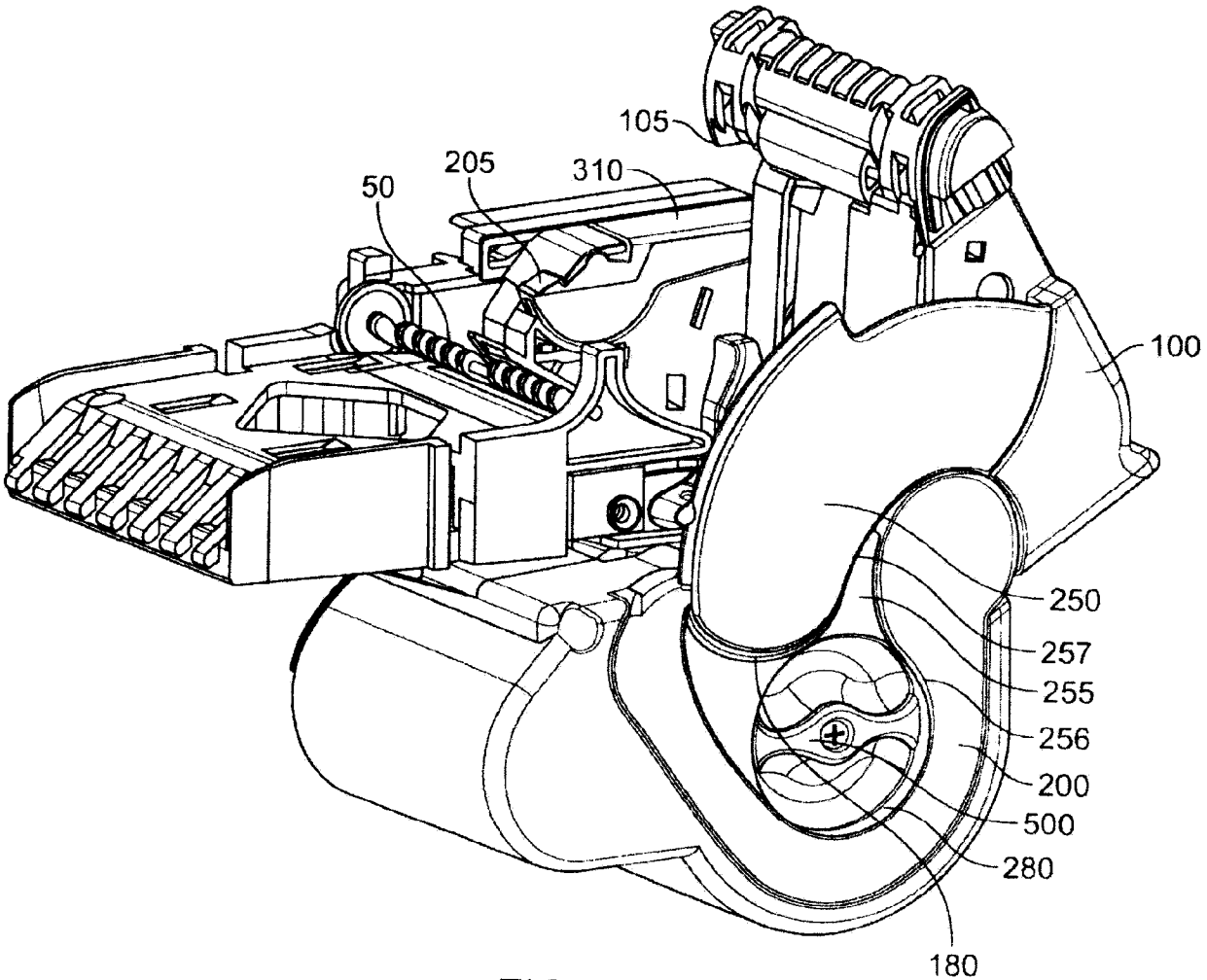
FIG. 3 illustrates the removable currency storage unit with a pivotable access cover in an open position.
Figure 4:
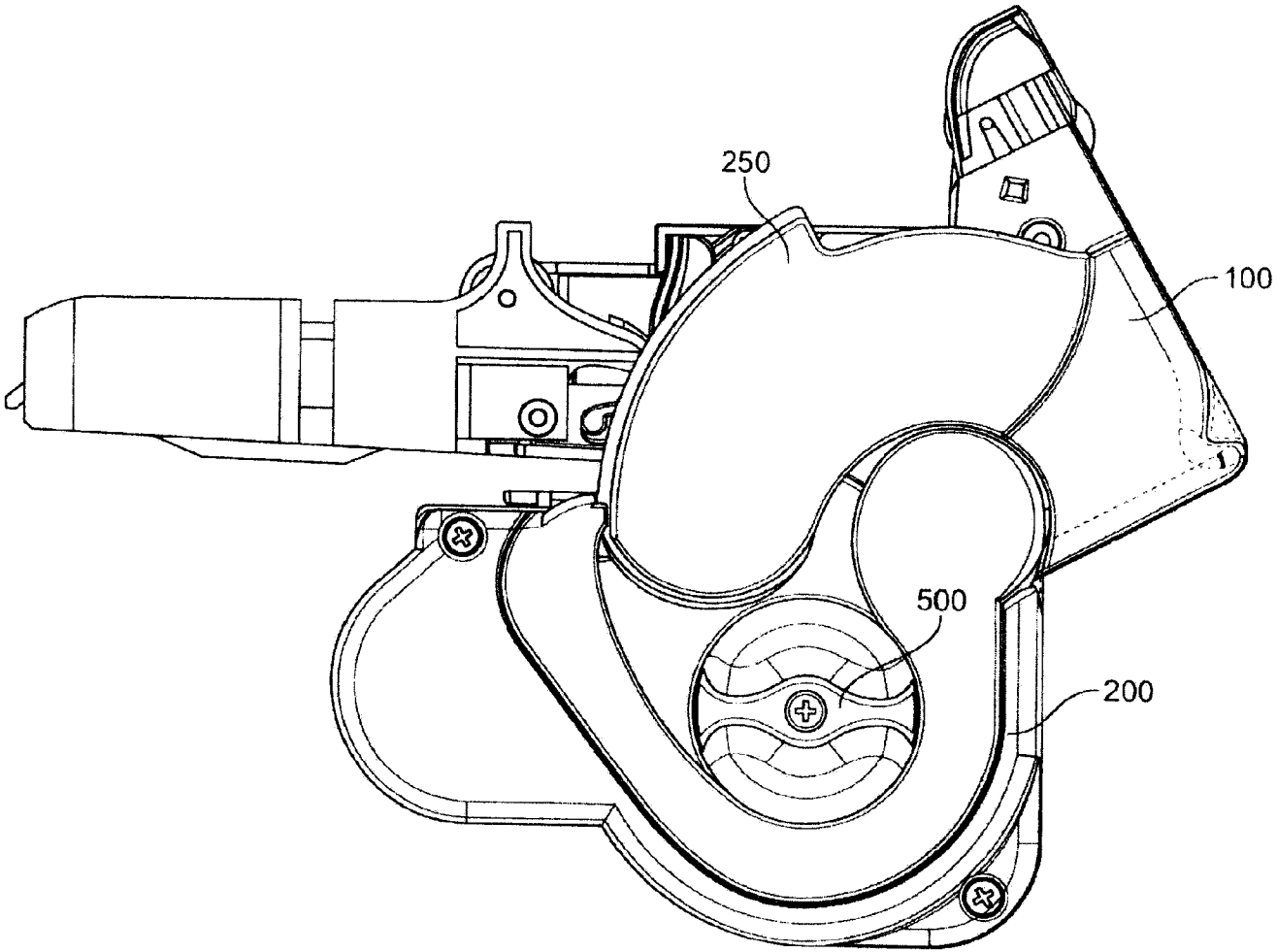
FIG. 4 is a side view showing the removable currency storage unit with the pivotable access cover in the open position.
Figure 5:
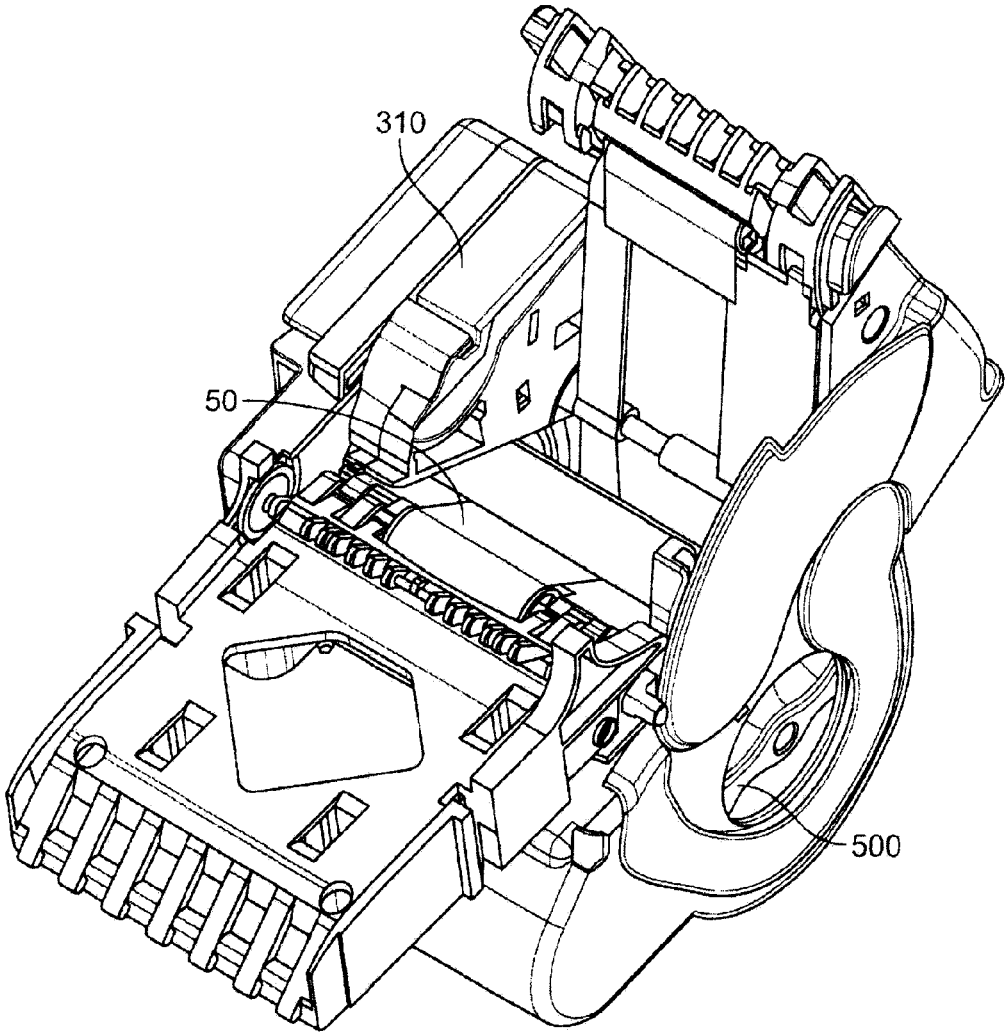
FIG. 5 is a perspective view showing a transportation path and manual adjustment crank of the currency storage unit.

FIG. 1 shows a removable currency storage unit 10 for selective coupling with a vending machine and configured to store bills. Removable storage unit 10 includes an upper housing 100 and lower housing 200 arranged to form bill path 50. Upper housing 100 is pivotally coupled to lower housing 200 about pivot 210 (see FIG. 2). Upper housing 100 is movable between a closed position (FIG. 1) and an open position (FIGS. 3, 4 and 5). Release lever 310 is operable to release upper housing 100 from lower housing 200 as will be explained in further detail below. Upper housing 100 sometimes is referred to as an 'access cover' as it allows access to the contents of the unit 10 when in the open position.

Referring to FIG. 3, upper housing 100 includes upper locking flange 105 arranged for hooking engagement with lower locking flange 205 of release lever 310. Release lever 310 is pivotally mounted to lower housing 200 (see FIGS. 3, 4 and 5). Other forms of securing upper housing 100 to lower housing 200 are contemplated as would be known to one skilled in the art. Clockwise rotation (when viewed from the perspective of FIG. 6) of release lever 310 causes upper and lower flanges 105, 205, respectively, to move out of engagement and thus allows upper housing 100 to be moved from a closed position, generally overlaying upper housing 200, to an open position exposing bill path 50. Movement of upper housing 100 from an open position (FIG. 3) to a closed position (FIG. 1) causes upper and lower locking flanges 105, 205, respectively, to become engaged and thus prevent movement of upper housing 100 relative to lower housing 200.

Figure 6:
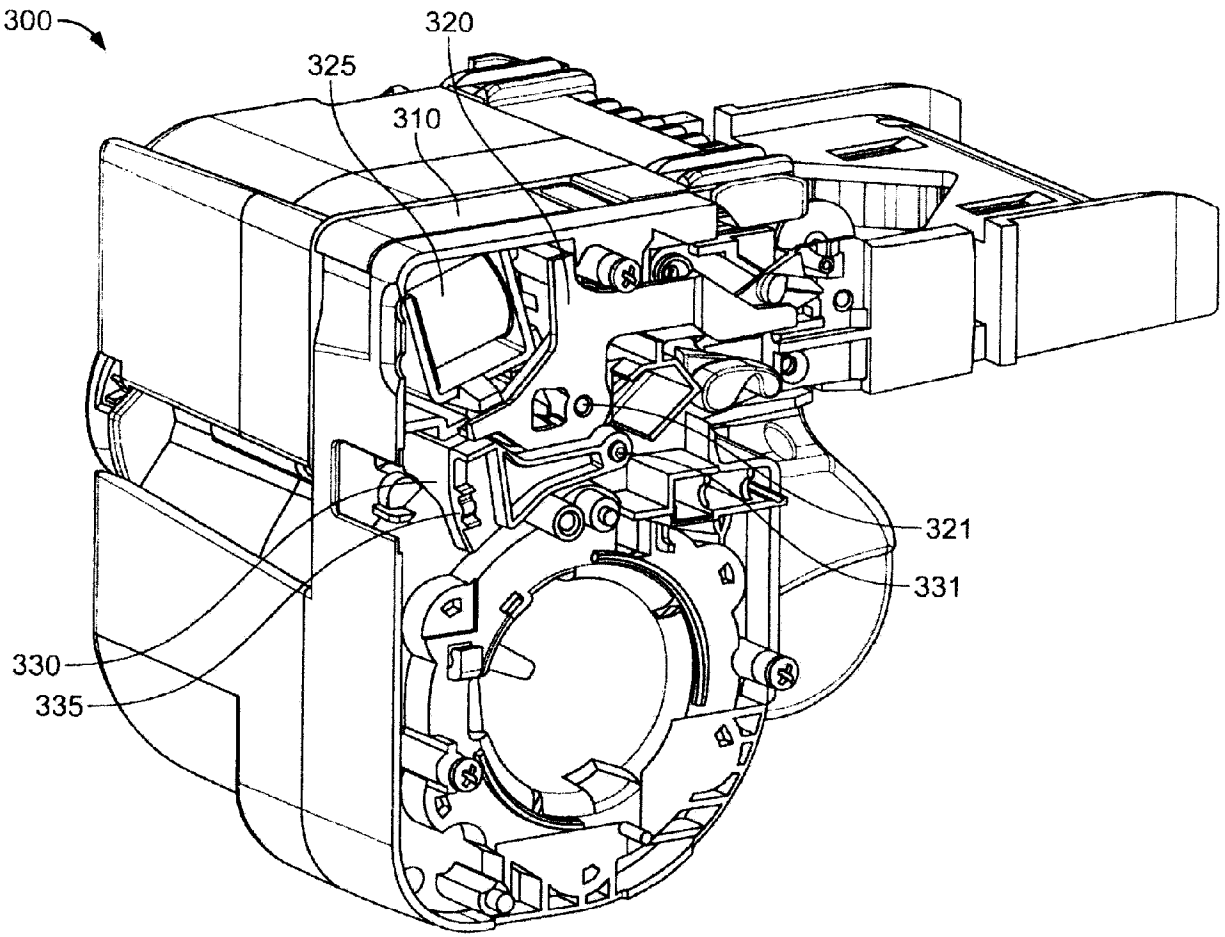
FIG. 6 illustrates details of an access identification mechanism for the removable currency storage unit.

As shown in FIG. 6, removable currency storage unit 10 includes access identification mechanism 300 for recording movement of upper housing 100 relative to lower housing 200. Access identification mechanism 300 is arranged to record when upper housing 100 has been moved from a closed position to an open position, thus exposing the contents of removable currency storage unit 10. Access identification mechanism 300 includes release lever 310, gate link 320, solenoid 325, switch lever 330, lever cam surface 335 and latch switch 365. As release lever 310 is moved in a clockwise direction (when viewed from the perspective of FIG. 6) gate link 320 moves counter-clockwise about pivot 321. Counter-clockwise rotation of gate link 320 causes switch lever 330 to rotate in a counter-clockwise direction about pivot 331. The movement of release lever 310 in a clockwise direction, which enables the release of upper housing 100 (but prior to any movement of upper housing 100), allows access identification mechanism 300 to be positioned in an initial set state A, which is explained in greater detail below.

Once access identification mechanism 300 has been actuated to state A, upper housing 100 can be moved from a closed position to an open position by pivoting about pivot 210 in a counter-clockwise direction (when viewed from the perspective of FIG. 6). As upper housing 100 rotates about pivot 210 in a counter clock-wise direction, cam 140 moves along cam surface 240. As cam 140 moves along cam surface 204, it becomes vertically displaced and causes switch lever 330 to be rotated in a clockwise direction about pivot 331. Switch lever 330 includes switch surface 335 in sliding relation with latch switch 365 (see FIGS. 7 and 8). In some implementations switch surface 335 includes a variable cam surface arranged to activate latch switch 365 (e.g., a button switch). Actuation of access identification mechanism 300 to state A ensures that latch switch 365 is in the upper position of switch surface 335.

Figure 7:
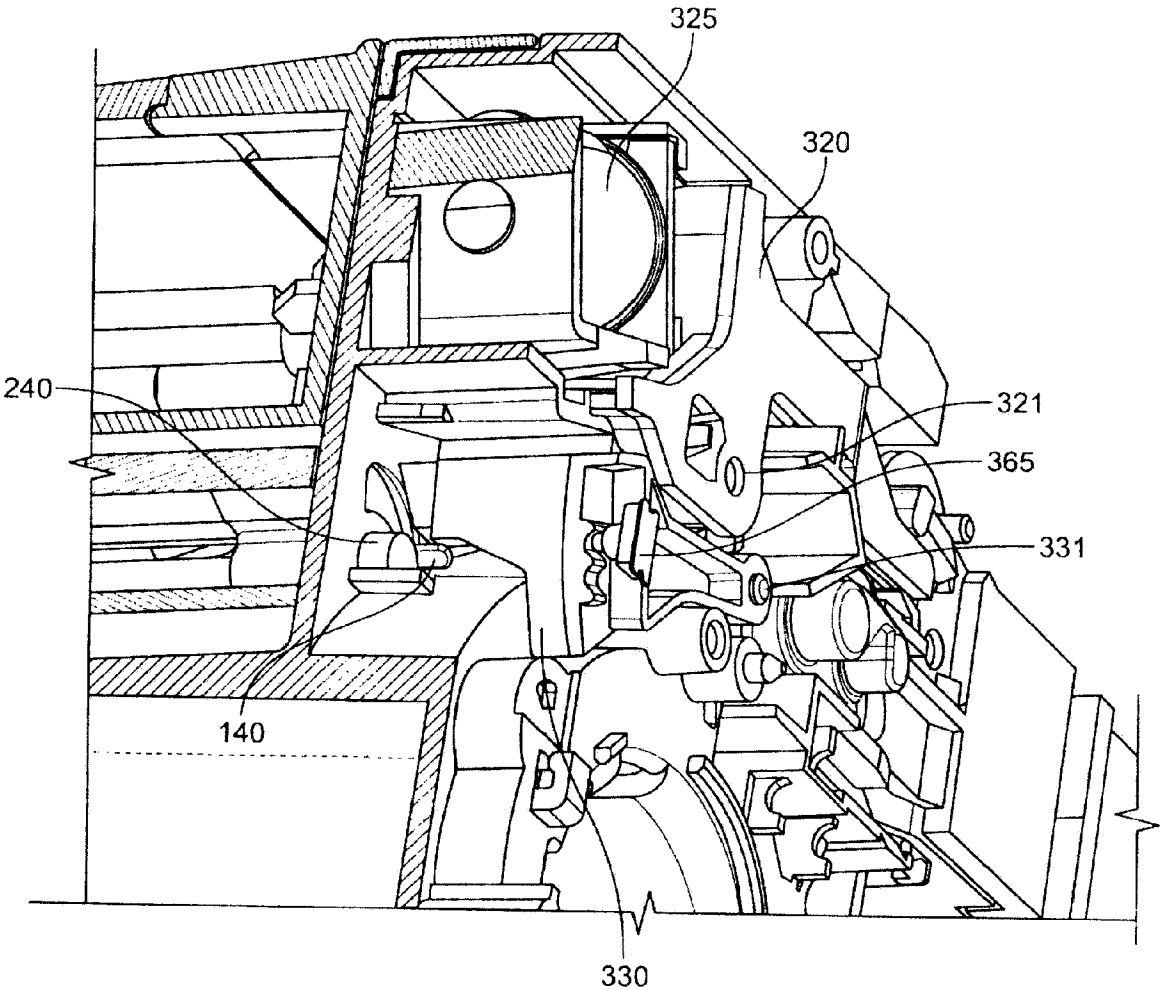
FIG. 7 is a close-up view showing various details of the access identification mechanism of FIG. 6.
Figure 8:
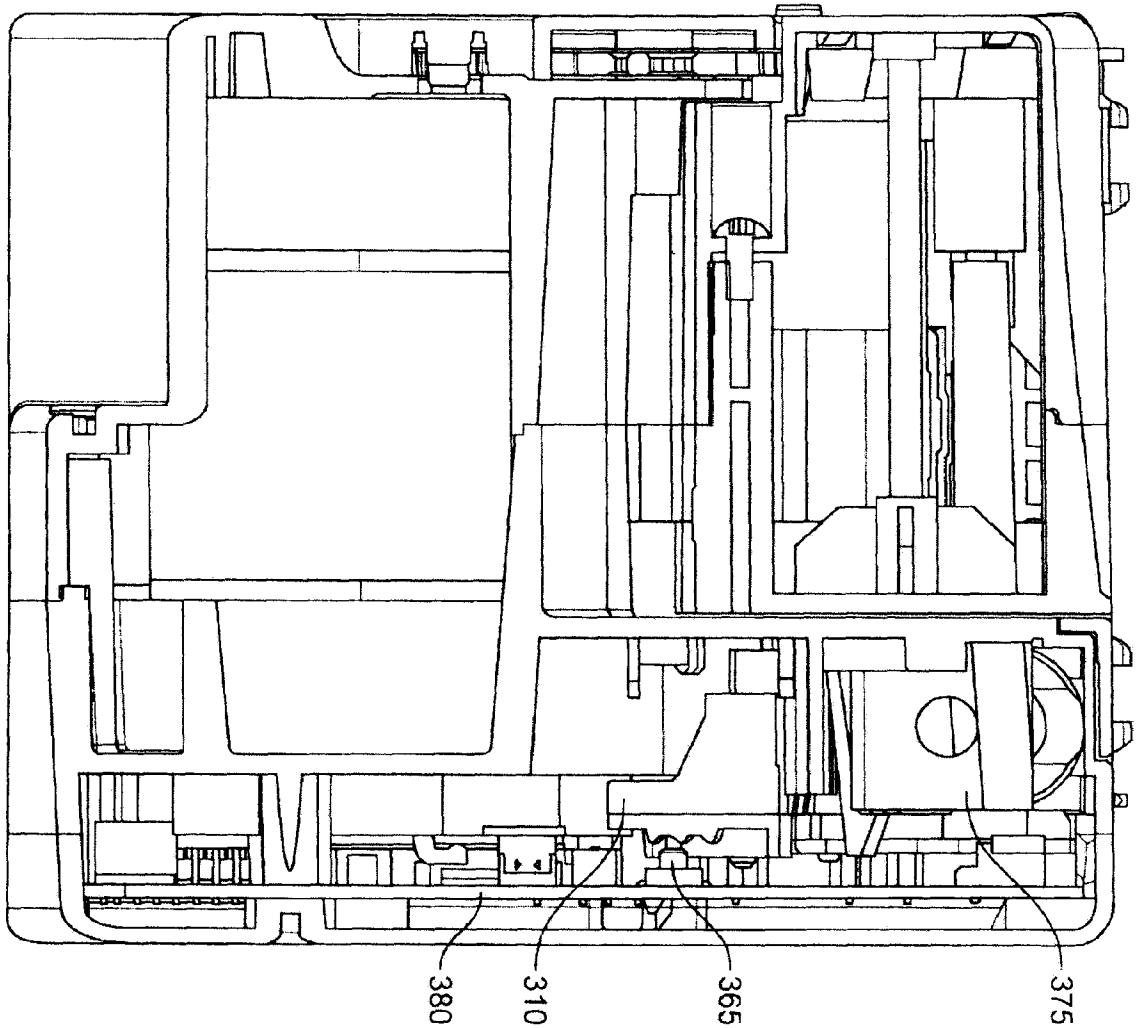
FIG. 8 is an end view showing various details of the access identification mechanism.

As shown in FIGS. 7 and 8, as upper housing 100 is rotated to the open position, cam 140 moves along cam surface 240 causing switch lever 330 to rotate in a clockwise direction. As switch lever 330 rotates in a clockwise direction, latch switch 365 is moved from the upper (e.g., first) position or state A of access identification mechanism 300, to the lower (e.g., second) position of switch surface 335 or state B of access identification mechanism 300. Switch lever 330 is maintained in state B position as upper housing 100 is moved from the open position to the closed position.

As upper housing 100 is moved from an open position to a closed position, upper housing 100 is rotated in a clockwise direction (when viewed from the perspective of FIG. 6). As upper housing 100 approaches the closed position upper flange 105 engages lower flange 205, thus locking upper housing 100 in the closed position. With removable currency storage unit 10 in a closed configuration, it can be inserted into the chassis of the host vending machine or a chassis of a money handling unit mounted within a host machine.

In other implementations switch surface 335 is arranged for changing the optical response of latch switch 365 (e.g., an optical switch).

After a removal event and subsequent replacement of a currency storage unit 10 with a money handling unit, the main control unit receives information from the currency storage unit 10 indicating whether or not access to the contents has occurred. The main control unit may be, for example, an integral component of the removable currency storage device or it may be external to the removable storage device. For example, the main control unit can include a microprocessor arranged to control the operation of the removable currency storage device. Communication of the main control unit with other components within the removable currency storage device can be conducted by various known techniques (e.g., bus communications). In other implementations, the main control unit is external to the removable currency storage device (e.g., a vending machine controller) and communication therewith also can be accomplished using known techniques (e.g., bus communications).

In some implementations, the main control unit sends an inquiry signal to the currency storage unit 10 upon connection to determine the status of access identification mechanism 300. In other implementations, the main control unit receives information from currency storage unit 10 upon insertion, and thus module power up, indicating the status of access identification mechanism 300.

In some implementations, the main control unit is arranged to monitor the state of access identification mechanism 300 such that upon power up of storage unit 10, access identification 300 mechanism is actuated to cause switch lever 330 to be forced into state A. the main control unit monitors the state of access identification mechanism 300 to determine if latch switch 365 produces an electrical signal indicating a movement of switch lever 330 from state B to state A. If a signal from latch switch 365 is obtained during the cycling of access identification mechanism 300, the main control unit receives information indicating that the contents of removable storage unit 10 has been accessed.

The host machine can provide operational power to currency storage unit 10 by known techniques (e.g., by a removable electrical connector). When currency storage unit 10 is coupled to the host machine, upper housing 100 is in locking engagement with lower housing 200. In some implementations, the host machine is configured such that when currency storage unit 10 is coupled to the host machine, other structural features of the host machine prevent physical movement of upper housing 100. Features on the chassis of the host machine or other peripheral modules can be provided to abut upper housing 100 such that upper housing 100 cannot be moved from a closed position to an open position even if release lever 310 is actuated to release upper flange 105 from lower flange 205. As upper housing 100 can be separated from lower housing 200 only when the unit 10 is removed from the host machine, access identification mechanism 300 can record an access event only when currency storage unit 10 is removed from the host machine.

In other implementations upper housing 100 is not prevented from being separated from lower housing 200 when coupled to the host chassis (or money handling unit chassis). In this configuration, access identification mechanism 300 can be monitored continuously by the main control unit and any state change of access identification mechanism 300 can allow the main control unit to execute a number of different operations. For example, the main control unit can disable operation of the removable currency storage unit 10 if the sensed access event information from the access identification mechanism 300 is deemed to be unauthorized.

When access identification mechanism 300 is in state A, information is provided by currency storage unit 10 indicating that no access to the contents of currency storage unit 10 has occurred. When access identification mechanism 300 is in state B, information is provided by currency storage unit 10 that access to the contents of currency storage unit 10 has occurred. The information provided by the state of access identification mechanism 300 is determined by the position of latch switch 365 relative to surface 335.

Upon insertion of currency storage unit 10 into the host machine (or money handling unit), power is provided to the unit. In some implementations, during the power up of currency storage unit 10, access identification mechanism 300 is cycled to ensure it is in state A. During the cycling process, solenoid 325 is actuated to cause switch lever 330 to rotate in a counter-clockwise direction about pivot 331. Rotation of switch lever 330 in this manner ensures latch switch 361 is in the state A position. During the cycling process of switch lever 330, the status of latch switch 365 is monitored for any state change. If latch switch 365 was previously in the state B position prior to cycling, cam surface 335 will cause activation of latch switch 365, thus producing information that latch switch 365 was previously located in state position B. The information received from the state change of latch switch 365 is passed to the main control unit indicating that upper housing 100 of currency storage unit 10 has been moved from the closed position to the open position since the last cycling of access identification mechanism 300. In some implementations, the main control unit can use the information received from access identification mechanism 300 to indicate that the content of currency storage unit 10 have been accessed.

In some implementations, latch switch 365 includes an optical sensor to sense the state change during cycling of access identification mechanism 300 to provide the main control unit with information as to whether the contents of currency storage unit 10 have been accessed.

In some implementations, currency storage unit 10 is arranged to store currency (e.g., banknotes) in a sequential manner about a winding drum. When currency storage unit 10 is configured to store banknotes about a drum, it sometimes is necessary to allow service personnel to rotate the drum manually to move banknotes stored on the drum. In some known drum storage devices, a manual hand crank allows for the manual movement of the drum, and thus the stored banknotes. In such devices the manual hand crank (or handle) is exposed when the currency storage unit 10 is coupled to the host machine. In some implementations of the invention, currency storage device 10 includes a manual hank crank 500 (FIG. 3) for movement of banknotes stored about a winding drum. A hand crank security cover 250 is provided to allow selective access to hand crank 500. Security cover 250 is mounted to upper housing 100 and configured to selectively allow access to hand crank 500 depending on the position of upper housing 100. When release lever 310 is actuated to cause upper and lower flanges 105, 205, respectively, to be disengaged, upper housing can be moved from a closed position to an open position when currency storage unit 10 is not coupled to the host machine.

Security cover 250 is arranged to prevent access to hand crank 500 when upper housing 100 is in the closed position. In some implementations, security cover 250 includes a perimeter 257 for sliding engagement with recess perimeter 256 of lower housing 200. Lower housing 200 is configured such that recess 255 allows security cover 250 to fit within recess perimeter 256 so as to prevent any overhang of security cover 250. In some implementations, security cover 250 includes a flange 180 for sliding engagement with cover locking recess 280 of lower housing 200. Mating engagement of cover flange 180 and cover locking recess 280, while upper housing is in a closed position, prevents security cover 250 from being displaced in an outward direction (i.e., to prevent unauthorized access).

In some implementations, currency storage unit 10 includes an access cover 100 that employs other than a pivotal arrangement. When currency storage unit 10 includes an access cover 100 that employs other than a pivotal arrangement, access identification mechanism 300 can be arranged to perform the same state monitoring function by monitoring the position of the access cover 100 (e.g., sliding or folding types). Other arrangements can be used for providing currency storage unit 10 with an access cover such that access identification mechanism 300 monitors any state change in the access cover 100 and main control unit receives the status information of access identification mechanism 300.

Other implementations are within the scope of the claims.

What is claimed is:

1. A content access monitoring system for a removable currency storage module having a movable access cover for exposing contents of the removable currency storage module, the content access monitoring system comprising:

an access identification mechanism for establishing whether the access cover has been moved between a closed position and an open position, the access identification mechanism including a movable member arranged to move between an initial state indicating a closed position of the access cover and a further state indicating movement of the access cover to an open position;

an actuation device for causing the movable member to be positioned in the initial state upon activation; and an electrical sensor arranged to send information relating to a state change of the moveable member based on activation of the actuation device.

2. The content access monitoring system according to claim 1 wherein the moveable member is a lever.

3. The content access monitoring system according to claim 1 wherein the actuation device comprises a solenoid.

4. The content access monitoring system according to claim 1 wherein the sensor is a button sensor.

5. The content access monitoring system according to claim 1 wherein the sensor is an optical sensor.

6. The content access monitoring system according to claim 1 wherein the removable currency storage module is arranged to store a currency type selected from the group consisting of: valuable documents and coins.

7. A removable currency storage module according to claim 1 wherein the access cover is arranged to slide relative to the housing.

8. A removable currency storage module for storing items of currency comprising:

a housing for containing items of currency therein, wherein the housing has a movable access cover for accessing contents of the housing wherein the access cover is arranged to pivot relative to the housing; and a content access monitoring system for monitoring movement of the access cover and providing information about the movement;

wherein the content access monitoring system is arranged to change from an initial state corresponding to no movement of the access cover to a further state corresponding to movement of the access cover.

9. A removable currency storage module comprising:

a movable handle for manually moving valuable documents into and out of the removable currency storage module;

a housing for securely storing valuable documents therein, the housing being operable between an open position and a closed position, the housing having a portion thereof defining a security cover arranged to provide selective access to the movable handle;

wherein the housing includes a first component and a second component;

wherein the security cover prevents access to the movable handle when the housing is in the closed position and allows access to the movable handle when the housing is in the open position.

10. A removable currency storage module according to claim 9 wherein the second component includes a receiving portion for receiving at least a portion of the security cover.

11. A removable currency storage module according to claim 9 wherein the first component is pivotably coupled to the second component.

12. A removable currency storage module according to claim 9 wherein the security cover includes a passive locking feature preventing movement of the security cover in a direction different from the direction of opening and closing of the housing.

13. A removable currency storage module according to claim 12 wherein the passive locking feature is a portion of the security cover mated with a portion of the second component.

14. An automated method for a removable currency storage module that includes an access cover that can be moved to provide access to contents of the removable currency storage module, the method comprising:

monitoring movement of the access cover;

determining whether the access cover has been moved from a closed position to an open position; and providing information about the movement to a control unit.

15. The method of claim 14 wherein determining whether the access cover has been moved from a closed position to an open position includes monitoring a position of a latch switch relative to a specified surface.

16. The method of claim 14 including recording the information about the movement of the access cover.

17. The method of claim 14 including providing information about the movement to the control unit in response to a query from the control unit.

18. A content access monitoring system for a removable currency storage module having a movable access cover for exposing contents of the removable currency storage module, the content access monitoring system comprising:

an access identification mechanism for establishing whether the access cover has been moved between a closed position and an open position, the access identification mechanism including a movable member arranged to move between an initial state indicating a closed position of the access cover and a further state indicating movement of the access cover to an open position;

an actuation device for causing the movable member to be positioned in the initial state upon activation; and a sensor arranged to send information relating to a state change of the moveable member based on activation of the actuation device;

wherein the moveable member is a lever.

19. A content access monitoring system for a removable currency storage module having a movable access cover for exposing contents of the removable currency storage module, the content access monitoring system comprising:

an access identification mechanism for establishing whether the access cover has been moved between a closed position and an open position, the access identification mechanism including a movable member arranged to move between an initial state indicating a closed position of the access cover and a further state indicating movement of the access cover to an open position;

an actuation device for causing the movable member to be positioned in the initial state upon activation; and a sensor arranged to send information relating to a state change of the moveable member based on activation of the actuation device;

wherein the actuation device comprises a solenoid.

20. A content access monitoring system for a removable currency storage module having a movable access cover for exposing contents of the removable currency storage module, the content access monitoring system comprising:

an access identification mechanism for establishing whether the access cover has been moved between a closed position and an open position, the access identification mechanism including a movable member arranged to move between an initial state indicating a closed position of the access cover and a further state indicating movement of the access cover to an open position;

an actuation device for causing the movable member to be positioned in the initial state upon activation; and a sensor arranged to send information relating to a state change of the moveable member based on activation of the actuation device;

wherein the removable currency storage module is arranged to store valuable documents.

* * * * *